US006430817B2

(12) United States Patent
Hoffman

(10) Patent No.: US 6,430,817 B2
(45) Date of Patent: Aug. 13, 2002

(54) DRYWALL CUTTING TOOL

(76) Inventor: Alvin R. Hoffman, 2231 34th Ave., Kenosha, WI (US) 53144

( * ) Notice: Subject to any disclaimer, the term of this patent is extended or adjusted under 35 U.S.C. 154(b) by 0 days.

(21) Appl. No.: 09/909,361

(22) Filed: Jul. 19, 2001

Related U.S. Application Data

(60) Provisional application No. 60/220,569, filed on Jul. 25, 2000.

(51) Int. Cl.[7] ..... B26B 3/08
(52) U.S. Cl. ..... 30/293; 30/294
(58) Field of Search ..... 30/286, 287, 289, 30/293, 294, 314

(56) References Cited

U.S. PATENT DOCUMENTS

| | | | | | |
|---|---|---|---|---|---|
| 2,004,517 | A | | 6/1935 | Homeier | 164/83 |
| 3,448,519 | A | * | 6/1969 | Tobias | 30/293 |
| 3,478,427 | A | | 11/1969 | Tims, Jr. | 30/293 |
| 4,064,626 | A | | 12/1977 | Meshulam et al. | 30/287 |
| 4,589,207 | A | | 5/1986 | Loth et al. | 30/287 |
| 4,949,462 | A | * | 8/1990 | Spencer | 30/293 |
| 5,203,086 | A | * | 4/1993 | Dann | 30/293 |
| 5,231,764 | A | * | 8/1993 | Chang | 30/293 |
| 5,815,929 | A | * | 10/1998 | Ojea | 30/294 |

* cited by examiner

*Primary Examiner*—Hwei-Siu Payer
(74) *Attorney, Agent, or Firm*—Donald J. Ersler

(57) ABSTRACT

A drywall cutting tool includes a slidable base, at least one cutting blade, and at least one fastener. The slidable base includes a first side face, a second side face, a front face, a rear face, and a flat bottom. The first and second side faces are preferably parallel to each other. The front and rear faces are also preferably parallel to each other. The first and second side faces are preferably perpendicular to the front and rear faces. The flat bottom is substantially perpendicular to the side faces, front face, and rear face. A blade slot is formed in at least one of said side faces. The blade slot is sized to securely retain a cutting blade. The cutting blade may be adjusted relative to the slidable body such that the portion thereof that extends from the flat bottom may be increased or decreased. The fastener is tightened or loosened to retain the position of the cutting blade relative to the flat bottom of the slidable body.

16 Claims, 3 Drawing Sheets

DRYWALL CUTTING TOOL

CROSS-REFERENCES TO RELATED APPLICATIONS

This is a utility patent application having priority from provisional application No. 60/220,569 filed on Jul. 25, 2000.

BACKGROUND OF THE INVENTION

1. Field of the Invention

The present invention relates generally to cutting tools and more specifically to a drywall cutting tool which may be used with a T-square to make straight cuts along a surface of a drywall board.

2. Discussion of the Prior Art

Currently, it appears that the only tool available for cutting drywall with a T-square is a box type cutting tool. The box type cutting tool is not adapted for following the edge of a T-square. As a result, the blade will wander from the edge of the T-square and not produce a straight line. It is possible for experienced drywall installers to cut a straight line. However, it is difficult for someone without extensive drywall cutting experience to cut a straight line along a T-square with a box type cutting tool.

Accordingly, there is a clearly felt need in the art for a drywall cutting tool which allows a person not experienced with cutting drywall to cut a straight line with a T-square along the surface of a drywall board.

SUMMARY OF THE INVENTION

The present invention provides a drywall cutting tool which allows an amateur handyman to make a straight cut on a surface of a drywall board with a T-square. A drywall cutting tool includes a slidable base, at least one cutting blade, and at least one fastener. The slidable base includes a first side face, a second side face, a front face, a rear face, and a flat bottom. The first and second side faces are preferably parallel to each other. The front and rear faces are also preferably parallel to each other. The first and second side faces are preferably perpendicular to the front and rear faces. The flat bottom is substantially perpendicular to the side faces, front face, and rear face.

A blade slot is formed in at least one of the side faces. The blade slot is sized to securely retain a cutting blade. The cutting blade is preferably the same as that used in a box cutter. The cutting blade may be adjusted relative to the slidable body such that the portion thereof that extends from the flat bottom may be increased or decreased. The fastener is tightened or loosened to retain the position of the cutting blade relative to the flat bottom of the slidable body.

Accordingly, it is an object of the present invention to provide a drywall cutting tool which may be effectively used by an amateur handyman.

Finally, it is another object of the present invention to provide a drywall cutting tool which may be easily used with a T-square to make straight cuts in a drywall board.

These and additional objects, advantages, features and benefits of the present invention will become apparent from the following specification.

DETAILED DESCRIPTION OF THE PREFERRED EMBODIMENTS

Figure 1:
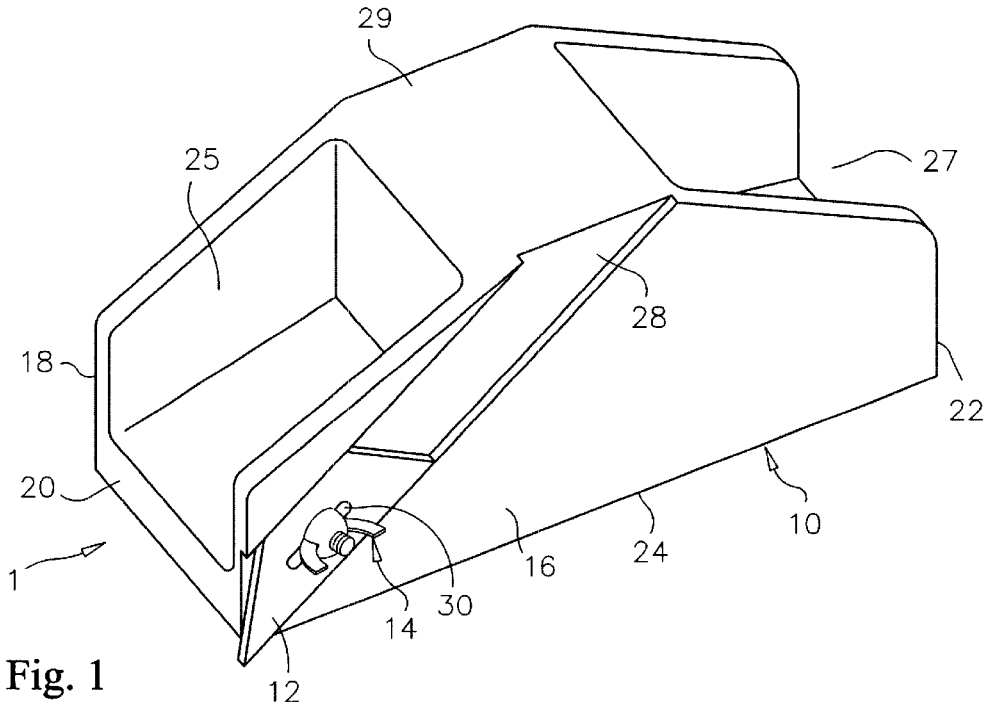
FIG. 1 is a perspective view of a drywall cutting tool in accordance with the present invention.
Figure 2:
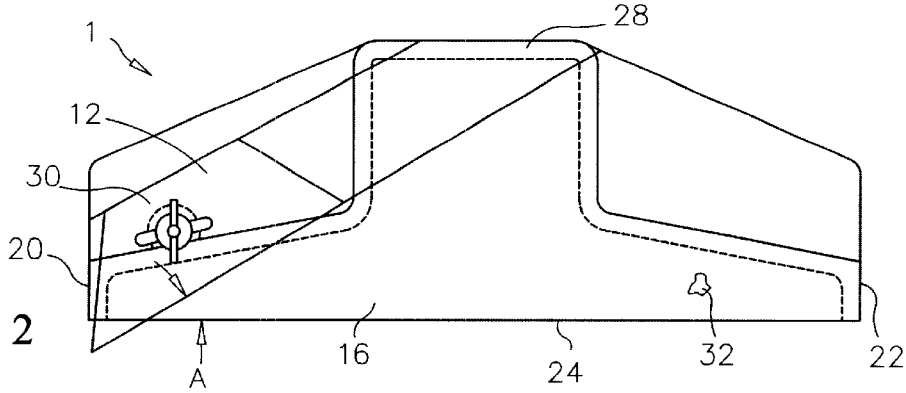
FIG. 2 is a first side view of a drywall cutting tool in accordance with the present invention.
Figure 3:
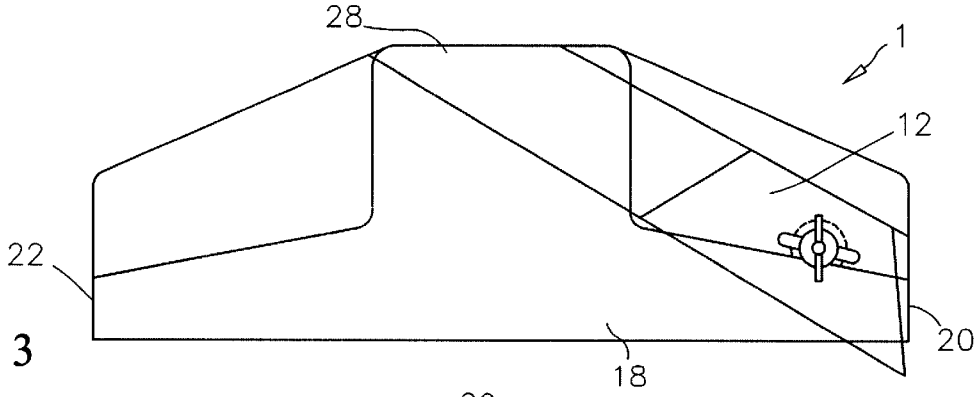
FIG. 3 is a second side view of a drywall cutting tool in accordance with the present invention.
Figure 4:
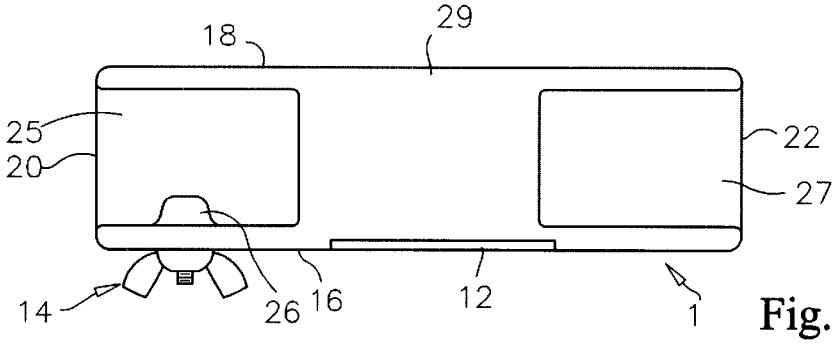
FIG. 4 is a top view of a drywall cutting tool in accordance with the present invention.
Figure 5:
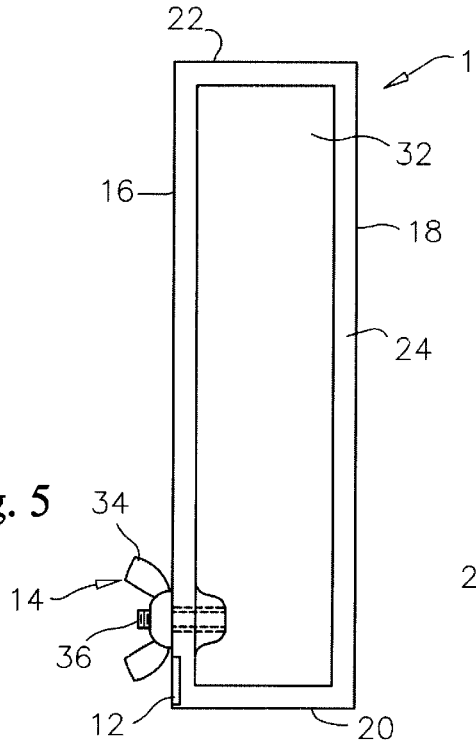
FIG. 5 is a front view of a drywall cutting tool in accordance with the present invention.

With reference now to the drawings, and particularly to FIG. 1, there is shown a perspective view of a drywall cutting tool 1. With reference to FIGS. 2–5, the drywall cutting tool 1 includes a slidable base 10, at least one cutting blade 12, and at least one fastener 14. The slidable base 10 includes a first side face 16, a second side face 18, a front face 20, a rear face 22, a flat bottom 24 and a top face 29. The first and second side faces are preferably parallel to each other. The front and rear faces are also preferably parallel to each other. The first and second side faces are preferably perpendicular to the front and rear faces. The flat bottom 24 is substantially perpendicular to the side faces, front face 20, and rear face 22. The bottom of the slidable body 10 must be flat such that it does not rock when placed on a drywall board. A front cavity 25 is formed in a front of the slidable base 10 and a rear cavity 27 is formed in a rear of the slidable base 10. The cavities are sized to allow the drywall cutting tool 1 to be grasped.

A blade slot 28 is formed in at least one of the side faces. The blade slot 28 is sized to securely retain a cutting blade 12. The depth of the blade slot 28 is preferably the thickness of the cutting blade 12. Angle "A" is preferably at least 25 degrees relative to the horizontal axis to optimize cutting of the drywall cutting tool 1. The cutting blade 12 has a lengthwise slot 30 formed in substantially the middle thereof. The cutting blade 28 is preferably the same size as that used in a box cutter with the exception of the lengthwise slot 30. The cutting blade 12 may be adjusted relative to the flat bottom 24 by sliding the cutting blade 12 up and down the blade slot 28. The fastener 14 is tightened or loosened to retain the position of the cutting blade 12 relative to the flat bottom 24.

Figure 6:
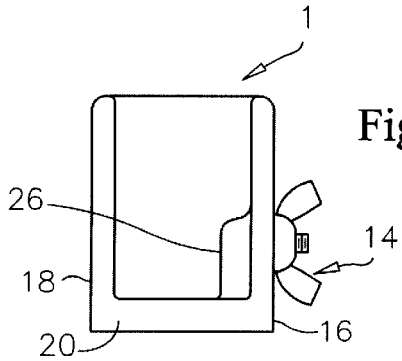
FIG. 6 is a bottom view of a drywall cutting tool in accordance with the present invention.

FIG. 6 shows a bottom view of the slidable body 10. A cavity 32 is preferably formed in the slidable body 10 to decrease weight and improve manufacturability. The fastener 14 preferably includes a wing nut 34 and threaded stud 36. The threaded stud 36 is preferably threaded into a boss 26 formed in the slidable body 10 such that it does not rotate. The wing nut 34 is tightened and loosened on the threaded stud 36 to retain the cutting blade 12. Other types of threaded and non-threaded fasteners may also be used. The slidable body 10 is preferably fabricated from die cast aluminum, but could be fabricated from plastic or any other material.

Figure 7:
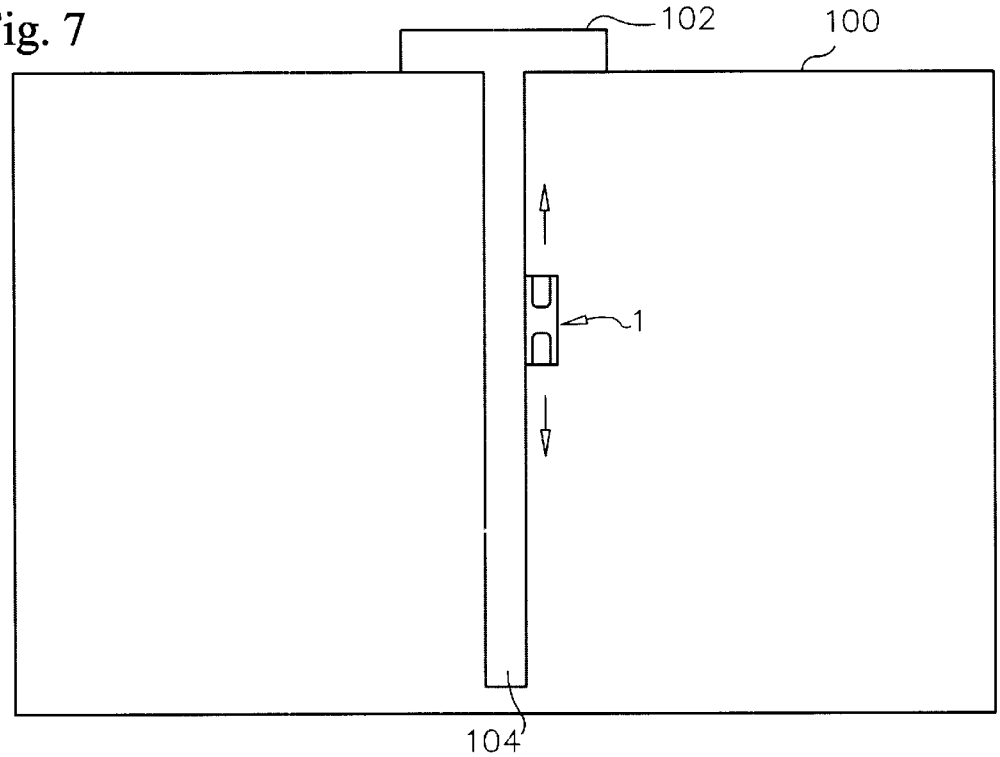
FIG. 7 is a top view of a drywall board with a T-square thereupon for guiding a drywall cutting tool along one of its side faces in accordance with the present invention.
Figure 8:
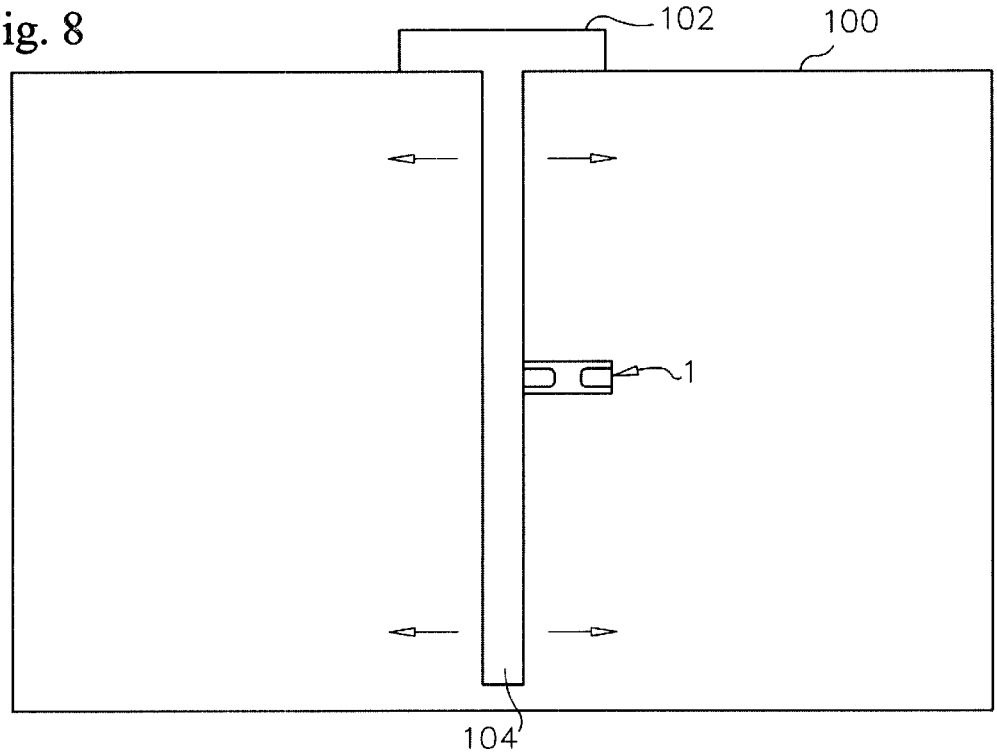
FIG. 8 is a top view of a drywall board with a T-square thereupon for guiding a drywall cutting tool along its front or rear face in accordance with the present invention.

FIGS. 7 and 8 show a top view of a T-square 102 on top of a drywall board 100. In FIG. 7, the T-square 102 is held stationary and one of the side faces of the drywall cutting tool 1 is moved along with an arm 104 of the T-square 102. In FIG. 8, the front or rear face of the drywall cutting tool is held against the arm 104 of the T-square 102 and the T-square 102 is moved along with the edge of the drywall board 100 to make a straight cut. Other straight edge devices besides a T-square may also be used to cut a straight line in a drywall board.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A drywall cutting tool in combination with a straight edge device comprising:

a cutting blade having at least one cutting edge;

a slidable body having a front cavity formed in a front thereof and a rear cavity formed in a rear thereof, said slidable body having a first side face, a second side face, a front face, a rear face, and a flat bottom;

said front cavity being bounded by said front face, said side faces, and a top face, said rear cavity being bounded by said rear face, said side faces, and said top face;

a slot being formed in at least one of said side faces, said slot being sized to securely retain said cutting blade; and a fastener being attached to said slidable body to retain said cutting blade, wherein said straight edge cutting device being placed on a drywall board, one of said faces of said drywall cutting tool being forced against said straight edge device to produce a straight cut in the drywall board.

2. The combination of claim 1 wherein:

said first side face being parallel to said second side face, said front face being parallel to said rear face, said front face being perpendicular to said side faces, said flat bottom being substantially perpendicular to one of said side faces.

3. The combination device of claim 1 wherein:

said cutting blade having a lengthwise slot disposed in substantially a middle of said cutting blade.

4. The combination of claim 1, further said fastener including a threaded stud and a wing nut, said threaded stud being secured into at least one said side face, said cutting blade being placed over said threaded stud, said wing nut being threaded on to said threaded stud.

5. The combination of claim 1 wherein:

a first cavity being formed in a bottom of said slidable body.

6. The combination device of claim 1 wherein:

said straight edge device being a T-square.

7. A drywall cutting tool comprising:

a cutting blade having at least one cutting edge, a lengthwise slot being disposed in substantially a middle of said cutting blade;

a slidable body having a first side face, a second side face, a front face, a rear face, and a flat bottom, one of said side faces being perpendicular to one of said front face and said rear face, said flat bottom being substantially perpendicular to one of said side faces, a first cavity being formed in a bottom of said slidable body;

a second cavity being formed in at least one of a front and a rear of said slidable body, said second cavity being bounded by one of said front face and said rear face, said side faces, and a top face;

a slot being formed in at least one of said side faces, said slot being sized to securely retain said cutting blade; and a fastener being attached to said slidable body to retain said cutting blade.

8. The drywall cutting tool of claim 7 in combination with a T-square wherein:

said T-square having an arm, wherein one of said side faces of said drywall cutting tool resting against said arm, said T-square being held stationary while said drywall cutting tool is moved relative to said arm to produce a straight cut in a drywall board.

9. The drywall cutting tool of claim 7 in combination with a T-square wherein:

said T-square having an arm, wherein said front face or said rear face of said drywall cutting tool resting against said arm, said T-square being moved relative to a drywall board while said drywall cutting tool is held stationary relative to said arm to produce a straight cut in the drywall board.

10. The drywall cutting tool of claim 7, wherein:

said first side face being parallel to said second side face, said front face being parallel to said rear face, said front face being perpendicular to said side faces.

11. The drywall cutting tool of claim 7, further comprising:

said fastener including a threaded stud and a wing nut, said threaded stud being secured into at least one said side face, said cutting blade being placed over said threaded stud, said wing nut being threaded on to said threaded stud.

12. A drywall cutting tool comprising:

a cutting blade having a lengthwise slot which is disposed in said cutting blade;

a slidable body having a first side face, a second side face, a front face, a rear face, and a flat bottom, a first cavity being formed in a bottom of said slidable body;

a second cavity being formed in at least one of a front and a rear of said slidable body, said second cavity being bounded by one of said front face and said rear face, said side faces, and a top face;

a slot being formed in at least one of said side faces, said slot being sized to securely retain said cutting blade; and a fastener being attached to said slidable body to retain said cutting blade.

13. The drywall cutting tool of claim 12 in combination with a T-square wherein:

said T-square having an arm, wherein one of said side faces of said drywall cutting tool resting against said arm, said T-square being held stationary while said drywall cutting tool is moved relative to said arm to produce a straight cut in a drywall board.

14. The drywall cutting tool of claim 12 in combination with a T-square wherein:

said T-square having an arm, wherein said front face or said rear face of said drywall cutting tool resting against said arm, said T-square being moved relative to a drywall board while said drywall cutting tool is held stationary relative to said arm to produce a straight cut in the drywall board.

15. The drywall cutting tool of claim 12, wherein:

said first side face being parallel to said second side face, said front face being parallel to said rear face, said front face being perpendicular to said side faces, said flat bottom being substantially perpendicular to one of said side faces.

16. The drywall cutting tool of claim 12, further comprising:

said fastener including a threaded stud and a wing nut, said threaded stud being secured into at least one said side face, said cutting blade being placed over said threaded stud, said wing nut being threaded on to said threaded stud.

* * * * *